US007384540B2

(12) United States Patent
Galeazzi

(10) Patent No.: US 7,384,540 B2
(45) Date of Patent: Jun. 10, 2008

(54) TWO-STEP METHOD FOR MIDDLE DISTILLATE HYDROTREATMENT COMPRISING TWO HYDROGEN RECYCLING LOOPS

(75) Inventor: Renaud Galeazzi, Paris (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 531 days.

(21) Appl. No.: 10/496,568

(22) PCT Filed: Nov. 22, 2001

(86) PCT No.: PCT/FR01/03685

§ 371 (c)(1),
(2), (4) Date: Nov. 22, 2004

(87) PCT Pub. No.: WO03/044132

PCT Pub. Date: May 30, 2003

(65) Prior Publication Data

US 2005/0167334 A1 Aug. 4, 2005

(51) Int. Cl.
*C10G 45/00* (2006.01)

(52) U.S. Cl. ..... 208/210; 208/213; 208/214

(58) Field of Classification Search ..... 208/210, 208/212, 213, 216, 217, 222; 422/144, 145, 422/147, 139
See application file for complete search history.

(56) References Cited

U.S. PATENT DOCUMENTS 5,925,234 A * 7/1999 Morel et al. ..... 208/96
5,968,347 A * 10/1999 Kolodziej et al. ..... 208/213
5,976,354 A 11/1999 Power et al.
6,042,716 A * 3/2000 Morel et al. ..... 208/89
6,221,239 B1 4/2001 George-Marchal et al.

FOREIGN PATENT DOCUMENTS

EP 1 063 275 12/2000

* cited by examiner

*Primary Examiner*—Walter D. Griffin
*Assistant Examiner*—Frank C Campanell
(74) *Attorney, Agent, or Firm*—Millen, White, Zelano, Branigan, P.C.

(57) ABSTRACT

A process for hydrotreating a hydrocarbon feed comprises at least two steps with intermediate stripping of the effluent from the first step with pressurized hydrogen substantially free of impurities which are undesirable for the catalyst for the second step, in particular to eliminate part of the $H_2S$ formed, each step being carried out with a hydrogen recycle loop that is exclusive to that step.

18 Claims, 2 Drawing Sheets

Figure 1:
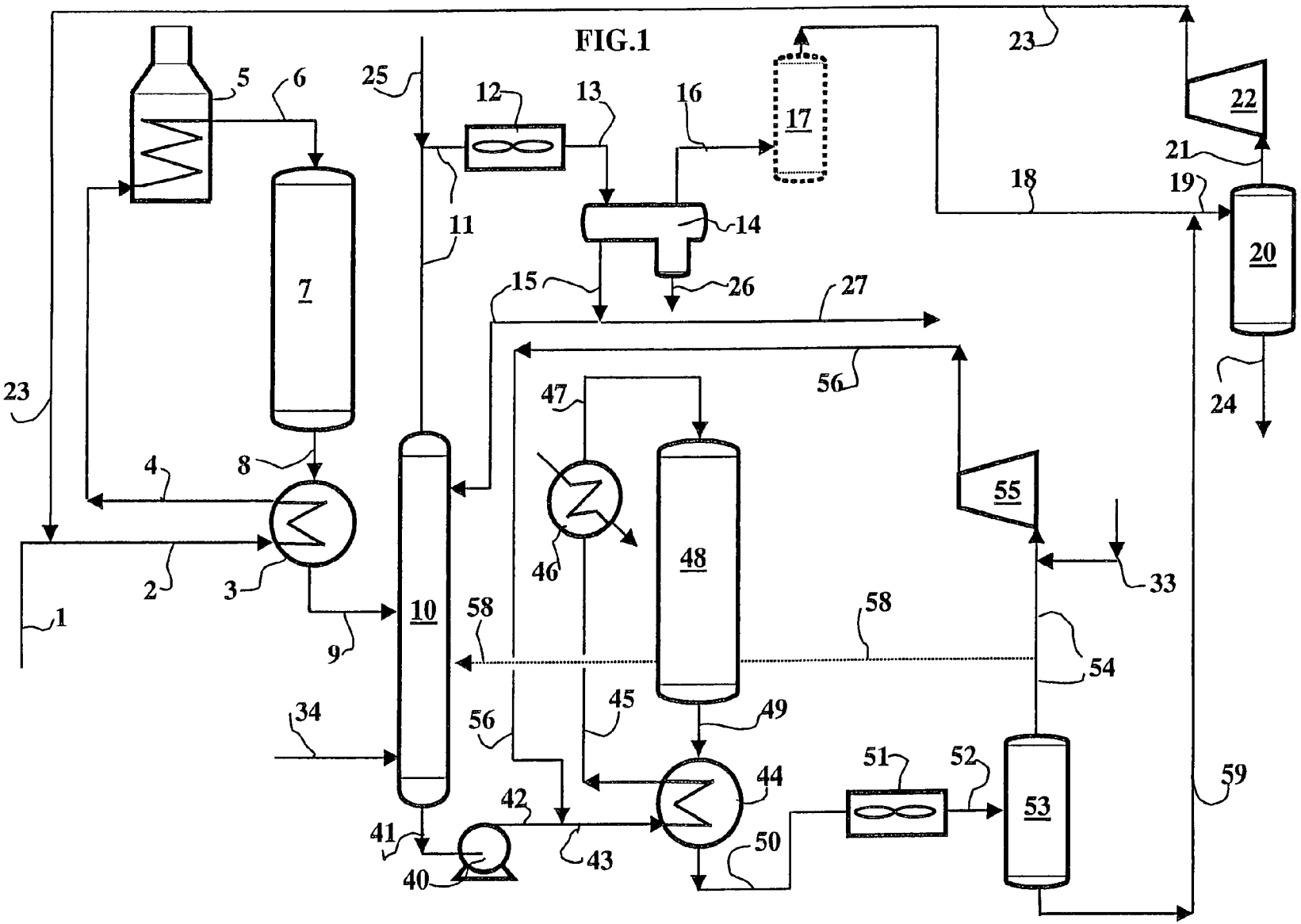

TWO-STEP METHOD FOR MIDDLE DISTILLATE HYDROTREATMENT COMPRISING TWO HYDROGEN RECYCLING LOOPS

The present invention relates to the hydrotreatment of hydrocarbon fractions, for example gasoline or middle distillates, to produce hydrocarbon fractions with a low sulphur content, low nitrogen content and low aromatics content, particularly for use in the field of internal combustion engine fuels. Such hydrocarbon fractions include jet fuel, diesel fuel, kerosene and gas oils. The invention can process middle distillate cuts with a very low cetane index, for example cuts comprising a high proportion of light cycle oil, LCO, to produce a fuel with a high cetane index, which is desulphurized and partially dearomatized.

Currently, middle distillate type cuts from straight run distillation of a crude oil or from a catalytic cracking process still contain non negligible quantities of aromatic compounds, nitrogen-containing compounds and sulphur-containing compounds. Current legislation in many industrialized states requires that fuel for use in diesel engines must contain less than about 500 parts per million (ppm) of sulphur, and that specification must soon be reduced to 50 ppm; very probably it will in the medium term be further reduced to 10 ppm or even less. Currently, the aromatics content of a diesel fuel is not regulated, but in some cases the amount of aromatics in base cuts must be limited in order to satisfy cetane index specifications.

Thus, changes in specifications render necessary the development of a reliable, efficient process for producing, from conventional straight run middle distillates or from catalytic cracking (LCO cuts) or from another conversion process (cokefaction, visbreaking, residue hydroconversion, etc), a product with improved characteristics both as regards the cetane index and as regards the aromatics or nitrogen content, and in particular the sulphur content.

The present invention concerns a high performance hydrotreatment process that can in particular be used to treat difficult feeds of mediocre quality to produce high quality fuels. It comprises at least two reaction steps with intermediate stripping of the effluent from the first step with pressurized hydrogen substantially free of impurities which are undesirable for the catalyst for the second step, in particular to eliminate part of the $H_2S$ formed, each step being carried out with a hydrogen recycle loop that is exclusive to that step.

That process means that the operational pressures for the two steps can be selected independently to have a very low pollutant level in the second step, in particular of $H_2S$ and water, and to be able to use a catalyst based on a noble metal or comprising a noble metal in the second step under the best service conditions for that catalyst, all with high energy efficiency.

The present invention also concerns a substantially desulphurized hydrocarbon fraction that is possibly partially dearomatized obtained using the process of the invention, and any fuel containing said fraction.

DEFINITIONS AND CONVENTIONS USED IN THE INVENTION

The present description of the invention will use the following notations, definitions and conventions:

ppm for parts per million, expressed by weight;

conventionally, the pressure of a reaction step is the pressure at the outlet from the reactor (or last reactor) of that step. Conventionally, the pressure of a hydrogen-rich recycle loop is the pressure at the intake of the recycle compressor;

the term "purity" as applied to a hydrogen-containing gas and designated "Pur" means a molar percentage of molecular hydrogen: as an example, a purity Pur1 of 85 for a gas means that the gas contains 85 mole % of hydrogen (molecular). Conventionally, a "hydrogen-rich gas" or "hydrogen" is a gas with a molecular hydrogen purity of more than about 50. Conventionally, the purity of a hydrogen-rich recycle gas (or purity of the gas in that loop) is the purity of the gas at the intake of the recycle compressor for that loop;

the term "recycle loop" or "hydrogen recycle loop" is applied to recycling a hydrogen-rich gas to a reactor after downstream gas/liquid separation and compression of the gas (or a portion of the gas) to allow recycling. By extension, a "recycle loop" also comprises the lines and equipment traversed by the recycle gas, possibly mixed with a liquid phase (such as the feed). In particular, a recycle loop comprises at least one recycle compressor, a hydrotreatment reactor, a gas/liquid separation drum downstream of the reactor and/or optionally, the portion of the pressurized hydrogen stripping column located above the supply, if that column is located on the recycle gas circuit: thus, a recycle loop comprises the lines and equipment located on the path of the recycle gas; it can thus also comprise branches and bypasses: as an example, a portion of the compressed gas can be removed from the stream of recycle gas upstream of the reactor and supply the reactor at an intermediate portion for use as a quench gas or as the stripping gas. The term "recycle loop" is thus used to qualify a closed circuit that can comprise, downstream of the recycle compressor, branches and parallel portions of the circuit, following the gas path, said portions generally joining together upstream of the recycle compressor or compressors for that loop. In contrast, open circuits are excluded from the term "recycle loop", such as circuits without recycling, or circuits for evacuating gas, for example to other facilities, for example circuits for evacuating gas taken from a recycle loop such as an excess gas or purge gas;

the feed for the process of the invention designates a liquid stream of hydrocarbons supplying a hydrotreatment zone and also a liquid stream recovered downstream of said hydrotreatment zone which can, for example, be termed a partially desulphurized feed, even if that partially desulphurized feed is chemically different from the initial feed primarily because sulphur has been eliminated from certain compounds, and also because of saturation of a portion of the aromatics and elimination of a fraction of that feed because of the formation of light gaseous products in the reaction steps which are not recovered in liquid form;

the term "hydrotreatment" relating to the process of the invention is applicable to processing a hydrocarbon feed under hydrogen pressure, the total pressure being in the range from about 2 to about 20 MPa, to carry out one or more chemical reactions from the group constituted by the following reactions: hydro-desulphurization, hydro-denitrogenation, hydro-demetallization (to eliminate one or more metals such as vanadium, nickel, iron, sodium, titanium, silicon, copper), and hydrodearomatization;

PRIOR ART

Hydrotreatment processes carried out in at least two steps are already known wherein the first step is generally a desulphurization step and the second step (or last step) is either a deep desulphurization step or a dearomatization step, or a combination of desulphurization and dearomatization; each step can comprise one or more reactors, one or more catalytic zones (or beds), and can use identical or different catalysts.

The catalysts used for hydrotreatment (hydrodesulphurization and/or hydrodemetallization, and/or hydrogenation, in particular of aromatics, and/or hydrodearomatization) generally comprise a porous mineral support, at least one metal or metal compound from group VIII of the periodic table (said group comprising cobalt, nickel, iron, rhodium, palladium, platinum, etc) and at least one metal or compound of a metal from group VIB of the periodic table (said group comprising molybdenum, tungsten, etc).

The sum of the metals or metallic compounds, expressed as the weight of metal with respect to the weight of finished catalyst, is usually in the range 0.5 to 45% by weight.

The sum of metals or compounds of metals from group VIII, expressed as the weight of metal with respect to the weight of finished catalyst, is usually in the range 0.5% to 15% by weight.

The sum of metals or compounds of metals from group VIB, expressed as the weight of metal with respect to the weight of finished catalyst, is usually in the range 2% to 30% by weight.

In a non-limiting manner, the mineral support can comprise one of the following compounds: alumina, silica, zirconia, titinium oxide, magnesia, or two compounds selected from the preceding compounds, for example silica-alumina or alumina-zirconium, or alumina-titanium oxide, or alumina-magnesia, or even three or more compounds selected from the preceding compounds, for example silica-alumina-zirconium or silica-alumina-magnesia.

The support can also either partially or completely comprise a zeolite.

A frequently used support is alumina, or a support composed principally of alumina (for example 80% to 100% of alumina); said support can also comprise one or more other elements or promoter compounds based, for example, on phosphorus, magnesium, boron, silicon, or comprising a halogen. As an example, the support can comprise 0.01% to 20% by weight of $B_2O_3$, or $SiO_2$, or $P_2O_5$, or a halogen (for example chlorine or fluorine), or 0.01% to 20% by weight of a combination of a plurality of these promoters.

Examples of routinely used catalysts are catalysts based on cobalt and molybdenum, or on nickel and molybdenum, or on nickel and tungsten, on an alumina support; said support can comprise one or more promoters such as those cited above.

Frequently, other catalysts comprising at least one noble metal or a compound of a noble metal are used, said noble metal usually being rhodium, palladium or platinum, and usually palladium or platinum (or a mixture of said elements, for example palladium and platinum).

The quantity of noble metal or noble metals in such catalysts is usually in the range 0.01% to about 10% by weight with respect to the finished catalyst.

Such noble metal type catalysts are generally more efficient than conventional catalysts, in particular for hydrogenation, and allow lower temperatures to be used with lower catalytic volumes. However, they are more expensive and more sensitive to impurities.

The operating conditions for hydrotreatment are well known to the skilled person:

The temperature is typically in the range about 200° C. to about 460° C.

The total pressure is typically in the range from about 1 MPa to about 20 MPa, generally in the range 2 to 20 MPa, preferably in the range 2.5 to 18 MPa, and highly preferably in the range 3 to 18 MPa.

The overall hourly space velocity of the liquid feed for each catalytic step is typically in the range from about 0.1 to about 12, and generally in the range from about 0.4 to about 10.

The hydrogen purity in the recycle loop is typically in the range 50 to 100.

The quantity of hydrogen with respect to the liquid feed for each catalytic step is typically in the range from about 50 to about 1200 $Nm^3/m^3$ at the reactor outlet, and usually in the range. from about 100 to about 1000 $Nm^3/m^3$ at the reactor outlet.

Other elements linked to the operating conditions, to the gas purification techniques, and to the catalysts used in hydrotreatment can be found in published documents and patents, and in particular but not in a limiting manner to the documents or patents cited in the present description, in particular in European patent application EP-A-0 1 063 275, pages 5 and 6.

In order to carry out the invention, and for each hydrotreatment reactor, the skilled person could employ one or more catalysts and the operating conditions disclosed in the prior art documents, in particular those summarized in the present application. The process of the invention is not, however, bound to a particular hydrotreatment catalyst or to particular operating conditions, but can be used with any hydrotreatment catalyst (or catalysts) and any hydrotreatment operating conditions already known to the skilled person or which could be developed in the future.

U.S. Pat. No. 6,221,239 describes a concatenation of hydrotreatment with vapour stripping of the products and hydrodearomatization. Stripping is conventional steam stripping. The pressure and the operating conditions of the stripper, in particular the operating pressure, are not specified, and thus it can be assumed that it is a conventional stripper for hydrotreatment products. Such a $H_2S$ stripper, typically disposed at the outlet from a hydrotreatment unit, operates at a relatively low pressure, conventionally about 0.5 to 1.2 MPa, to encourage stripping, and avoids any condensation of water in the stripper itself. The hydrotreatment strippers also operate at a relatively low pressure to be able to use less vapour, and also low or medium pressure vapour, which is relatively cheaper than high pressure vapour. A typical variation of the facility of said process thus has two successive units: hydrotreatment with vapour stripping of $H_2S$, then a dearomatization unit, each unit having its hydrogen recycle loop. That process employs specific catalysts for the two units, including a catalyst based on a noble metal.

That process can produce deep denitrogenation and desulphurization at the outlet from the first reaction section, and can use a noble metal catalyst for the hydrogenation section. It can also produce a high hydrogen purity in the hydrogenation section, vapour stripping possibly allowing elimination of the light hydrocarbons over and above $H_2S$. However, it has a number of disadvantages:

The first is linked to energy efficiency, which is not optimal since steam is used for stripping, which steam has to be produced with a considerable energy output, then condensed.

Further, the catalyst comprising a noble metal or noble metal compound is not used under ideal conditions: steam stripping results in a high water content in the stripped liquid; however, the water content should be minimized as water is typically deleterious to the activity of hydrotreatment catalysts of that type.

The use of a low pressure stripper means that the stripped product has to be pumped at a high differential pressure. It also necessitates reheating the feed for the stripper from a temperature by about 50° C. to about 200° C. to 300° C. (in a series of two hydrotreatment units, the effluent from each unit is typically cooled to about 50° C.). This requires the installation of a number of exchangers.

Patents concerning hydrotreatment processes with two or more steps integrated with intermediate $H_2S$ stripping using high pressure hydrogen are also known; such processes mean that the second and/or last step can be operated with a very low $H_2S$ content:

U.S. Pat. No. 5,114,562 describes a process for hydrotreatment of a middle distillate in at least two consecutive steps to produce desulphurized and dearomatized hydrocarbon cuts comprising a first hydrodesulphurization step the effluent from which is sent to a hydrogen stripping zone to eliminate the hydrogen sulphide it contains. The desulphurized fraction obtained is sent to a second reaction zone, particularly for hydrogenation, comprising at least two reactors in series in which the aromatic compounds are hydrogenated. The stripping zone does not have a reflux; the light hydrocarbons entrained at the stripper head and which are recycled to the hydrogenation then to the hydrodesulphurization reduce the partial pressure of hydrogen required for the reaction. That process uses a single recycle loop which results in substantial uniformization of the hydrogen purity, in particular the amount of light hydrocarbons containing 1 to 4 carbon atoms (C1, C2, C3, C4) in the different reaction zones and in the use of fairly close operating pressures in said zones.

U.S. Pat. No. 5,110,444 describes a process comprising hydrotreatment of a middle distillate in at least three distinct steps. The effluent from the first hydrodesulphurization step is sent to a hydrogen stripping zone to eliminate the hydrogen sulphide it contains. The desulphurized liquid fraction obtained is sent to a first hydrogenation zone the effluent from which is sent to a second stripping zone distinct from the first. Finally, the liquid portion from the second stripping zone is sent to a second hydrogenation zone. The stripping zone does not include a reflux, and the light hydrocarbons entrained at the head of the stripper are also recycled to the hydrodesulphurization, which causes a reduction in the partial pressure of hydrogen in that step. That process thus uses a single recycle loop, with the same consequences as the patent cited above.

European patent application EP-A-1 063 275 describes a process for hydrotreatment of a hydrocarbon feed comprising a hydrodesulphurization step, a step in which the partially desulphurized effluent is sent to a hydrogen stripping zone then to a hydrotreatment step to obtain a partially dearomatized and substantially desulphurized effluent. In that process, the gaseous effluent from the stripping step is cooled to a temperature sufficient to form a liquid fraction which is returned to the head of the stripping zone. The pressure in the hydrodesulphurization and hydrotreatment steps is in the range 2 MPa to 20 MPa. There is no suggestion of any advantage in operating at different pressures that are higher or lower in one of the two steps.

Elsewhere, one or two recycle compressors are suggested, said two compressors taking in the recycle gas from a common line, one of the two compressors taking in the gas after a drying and desulphurization operation.

Because of their common origin (circulation in a common line), the gas supplying the two compressors have substantially identical compositions as regards their light hydrocarbon contents (C1, C2, C3, C4). The process described thus uses two recycle loops which are mixed in a common line, which can be assimilated with a single recycle loop and also results in uniformization of the purity of the recycle gas in the different reaction zones and the use of relatively close pressures.

All of those hydrotreatment processes with intermediate pressurized hydrogen stripping have common elements: stripping is carried out with hydrogen (typically water-free or low in water); after stripping, hydrogen is recycled in the hydrogen loop, which results in stripping at high pressure (that of the hydrogen loop), and which does not substantially depressurize the liquid effluent from the first step prior to stripping. The two hydrotreatment steps are also highly integrated with a common or mixed hydrogen loop (mixture of hydrogen from the different circuits).

By comparison with the process of U.S. Pat. No. 6,221,239, those processes have several advantages: no steam is consumed for stripping; no additional water is introduced into the stripped liquid; there is no need for a pump or only one pump with a relatively low differential pressure to transfer the stripped liquid.

In contrast, they have the following drawbacks:

The integrated hydrogen loop results in the use of similar pressures for the two (or more) reaction steps, and prevents independent optimization of the operating pressures as a function of the required specifications for the final product. To modify existing units (the operating pressure of which cannot be modified), the addition of a reaction step and a supplemental reactor to obtain a product with more severe specifications means that this step and the reactor must be designed and sized to have a pressure close to that of the existing unit, which is sometimes far from optimal.

Further, when using a catalyst in step a3) that is sensitive to impurities, the integrated or mixed recycle loop results either in processing the hydrogen of that loop using expensive means to eliminate impurities, or using a cheaper treatment and accepting traces of impurities and conditions of service for the catalyst that are not optimal.

Finally, the integrated or mixed recycle loop leads to the presence of light hydrocarbons in the recycle gas in all of the reaction steps, while said hydrocarbons are only generally produced in large quantities during the first desulphurization step. This results in a reduction in the purity of the hydrogen and the partial pressure of hydrogen (molecular), which reduces the rate of the hydrotreatment reactions.

The technologies used in the process with steam stripping and in the integrated processes with intermediate stripping with pressurized hydrogen are not equivalent and cannot be combined: it is not possible to carry out simultaneous hydrogen and steam stripping under high and low pressure, nor is it possible to use both a non-integrated process and a highly integrated process at the same time.

However, the Applicants have surprisingly discovered that it is possible to carry out a process having the advantages of the processes described above without suffering their drawbacks. The process of the invention can in particular:

- independently optimize the operating pressures of the different reaction steps;
- provide high energetic efficiency, not necessitating the consumption of steam for the intermediate stripping between the reaction steps, typically with limited cooling and/or heating of the product between the two reaction steps (upstream/downstream of the stripping column);

carry out stripping without notable depressurization and without requiring a pump to take up the product stripped at a high differential pressure;

obtain a recycle gas that is substantially free of impurities such as $H_2S$ and/or $H_2O$ in the second reaction step, and thus can use high performance impurity-sensitive catalysts under optimal conditions without very expensive treatment of all of the hydrogen supplying the step under consideration;

greatly reduce the quantity of light hydrocarbons present in the recycle gas supplying the second reaction step, which increases the purity of said gas and the catalytic activity.

DESCRIPTION

A typical feed for the process of the invention is a middle distillate feed. Within the context of the present invention, the term "middle distillate" designates hydrocarbon fractions boiling in a range of about 130° C. to about 410° C., generally about 140° C. to about 375° C., for example about 150° C. to about 370° C. A middle distillate feed can also include a gas oil or diesel cut or can be designated by one of these terms.

The process of the present invention can also be applied to the treatment of straight run hydrocarbon fractions with a boiling point located in the naphtha range: it can be used to produce hydrocarbon cuts for use as solvents or diluents and preferably containing a reduced aromatics content; the term "naphtha" designates a hydrocarbon fraction comprising hydrocarbons containing 5 carbon atoms to hydrocarbons with an end point of about 210° C.

The process can also be used for the hydrotreatment and desulphurization of gasoline, in particular gasoline produced by a fluid catalytic cracking facility (FCC) or other gasoline fractions deriving, for example, from cokefaction, visbreaking, or residue hydroconversion units, the term "gasoline" designating a hydrocarbon fraction from a cracking unit boiling between about 30° C. and about 210° C.

A further possible feed is kerosene. The term "kerosene" designates a hydrocarbon fraction boiling in the range about 130° C. to 250° C.

The process of the invention can also be used for hydrotreating heavier cuts, such as a vacuum distillate boiling in the range about 370° C. to 565° C.

The process of the invention can also be used for hydrotreating heavier cuts than a vacuum distillate, in particular deasphalted oil cuts.

The term "deasphalted oil" designates a cut boiling above about 565° C. (or at a slightly lower temperature such as about 525° C.) obtained by deasphalting a heavy residue, for example a vacuum residue, using a propane, butane, pentane, light gasoline type solvent or any other suitable solvent that is known to the skilled person.

Finally, the process can be used for hydrotreating a broader hydrocarbon cut resulting, for example (in a non limiting manner,) from mixing at least two of the fractions defined above.

It is also possible to use residual feeds, for example the vacuum residue boiling above about 565° C. and comprising asphaltenes, non-vaporizable.

The process of the invention comprises the following steps:

a first step a1) for hydrotreatment in which said feed and excess hydrogen are passed over a first hydrotreatment catalyst to convert at least the major portion of the sulphur contained in the feed into $H_2S$;

downstream of step a1), a step a2) for stripping the at least partially desulphurized feed from step a1) in a pressurized stripping column, preferably with a liquid reflux, using at least one hydrogen-rich stripping gas, to produce at least one hydrogen-rich gaseous stripping effluent and at least one liquid stripping effluent, the gaseous stripping effluent being at least partially compressed and recycled to the inlet to the first step a1) using a first recycle loop REC1;

downstream of step a2), a second hydrotreatment step a3) in which the stripped liquid effluent and excess hydrogen are passed over a second hydrotreatment catalyst (different from or identical to the first), the effluent from said step a3) being fractionated, in a gas/liquid separation step a4), into a hydrogen-rich gaseous fraction and a hydrotreated liquid fraction, said hydrogen-rich gaseous fraction being at least partially compressed and recycled to the inlet to step a3) using a second recycle loop REC2 separate from the loop REC1.

The term "separate loop" means that the two loops are distinct (compared with a single loop supplying the different hydrotreatment steps in parallel or in series), they comprise different means for compressing the recycle gas, and have neither a common portion nor a common point where the recycle gas supplying the two loops is collected and mixed; in contrast, it does not exclude connections between the two loops such as one or more lines for evacuating a purge gas from one loop to the other loop.

If the purge gas is evacuated from loop REC2 to loop REC1, there is no need to treat the purge gas the impurities content of which, in particular $H_2S$, is low, while the hydrotreatment step a1) is often carried out with a substantial $H_2S$ content.

If the purge gas is evacuated from loop REC1 to loop REC2, it is preferable for that purge gas does not introduce too high a proportion of undesirable impurities into loop REC2. Thus, that purge gas could generally be treated (alone or possibly mixed with a further recycle gas stream) to eliminate the major portion of the $H_2S$ contained in the purge gas, and possibly water if the catalyst for the second step is highly sensitive to water. Examples of such treatments are given below in the present application.

The flow rate of the purge gas is generally relatively low compared with the flow rate of a recycle loop, and so treatment of any purge gas (from loop REC1 to loop REC2) is only applied at a low gas flow rate (typically less than 50% or even less than 30% of the flow rate of each of the recycle loops REC1 and REC2 (flow rate measured by convention at the recycle compressor).

In a preferred embodiment, the loop REC2 is supplied with hydrogen independently of the loop REC1 by one or more streams of hydrogen exclusively constituted by stream(s) of external makeup hydrogen to loop REC1. This produces a recycle gas with very high purity in loop REC2.

In the process of the invention, loop REC2 is not common, has no common part and has no mixing point with loop REC1 combining the two recycle gases. In the preferred implementation in which loop REC2 is supplied with hydrogen independently of loop REC1, it is thus not polluted with compounds that may be found in loop REC1.

The absence of a mixing point also means that the pressures in the two loops can be decoupled and the pressure of the second loop in particular can be adapted to its requirements. This has an advantage when satisfying severe specifications, which in some cases, for example with very low quality feeds, can require relatively high pressures in one of the hydrotreatment steps (especially the last step), but not necessarily both steps. As an example, a pressure. in step a3) that is higher than that in step a1) by at least 1.2 MPa can be used.

In other cases, however, the pressure in the second step can be relatively close to that in the first step, for example a pressure that is higher than or equal to the first step by about 0 to 1.2 MPa, or even a pressure lower than that of the first step.

Decoupling of the two loops in combination with stripping can also eliminate from loop REC2 pollutants which are only present in large quantities in part of the recycle (loop REC1) and to use high performance catalysts which are sensitive to certain pollutants in the second or last hydrotreatment step without reintroducing those pollutants in the second or last hydrotreatment step via a recycle gas that is common or mixed for the two steps. In the case in which purge gas is evacuated from the first loop REC1 to the second loop REC2, the cost of the treatment for purifying said purge gas ($H_2S$ elimination and possibly water elimination) is limited, much lower than the cost of treating all of the recycle gas for the REC2 loop because the flow rate of the purge gas is typically relatively low (for example at most 50% and in particular at most 30% of the flow rate of the gas in any one of the two loops).

The stripping column, which preferably operates at a (column head) pressure close to the pressure of step a1) (for example at a pressure lower than that in step a1) by about 0 to 1 MPa, preferably about 0 to 0.6 MPa), can essentially eliminate compounds that are undesirable for the second reaction step: using a hydrogen-rich stripping gas that is substantially free of pollutants: $H_2S$, $NH_3$ (and possibly water), these pollutants can be stripped and essentially eliminated from the column bottom product (the liquid stripping effluent) before supplying the second reaction step.

The degree of hydrodesulphurization in step a1) and the stripping efficiency (linked to the number of theoretical plates in the column) are preferably adjusted so that the $H_2S$ content in the loop REC2 is limited, for example to less than 1000 ppm or 200 ppm. A preferred content, in particular if a thioresitant catalyst is not used, is generally less than 100 ppm, or even less than 50 ppm. The most preferred content is below 10 ppm, in particular less than 5 ppm. In the case in which a sulphur-resistant catalyst is used in the second reaction step, however, it is possible to have more than 500 ppm or even more than 1000 ppm of $H_2S$ in the REC2 loop.

The stripping zone of the stripping column (the zone located below the supply) can, for example, have an efficiency corresponding to 3 to 60 theoretical plates, and generally 5 to 30 theoretical plates, for example 8 to 20 theoretical plates, limits included.

A preferred implementation of stripping step a2) consists of using a stripping column that also includes a zone for rectification of the stripping vapours (located above the supply) with a liquid reflux (substantially to the head of the rectification zone). Rectification ensures that substantially all of the liquid products flow back to the column bottom or possibly principally the relatively heavy sulphur-containing products that are difficult to desulphurize, depending on the variation of the process of the invention, as explained below. It can recover and subject to the second hydrotreatment step all compounds for which deep complementary hydrotreatment is sought.

The number of theoretical plates in the rectification zone is generally in the range 1 to 30, preferably in the range 2 to 20, and highly preferably in the range 5 to 14, limits included.

Preferably, the total effluent from the reactor for step a1) supplies the stripping column, the gas contained in the effluent from the reactor also undergoing rectification using a liquid reflux. However, the scope of the invention also encompasses prior separation of the gas contained in the effluent from the step a1) reactor upstream of the stripping column.

Preferably, the effluent from reaction step a1) is only partially cooled before entering the stripping column. The inlet temperature for the stripping column is generally at least 140° C., often at least 180° C., and frequently in the range 180° C. to 390° C.

Preferably, the liquid reflux is obtained by cooling and partially condensing the column head vapours then separating the cooled stream in a gas/liquid separator drum or a reflux separator drum. Preferably, said vapours are cooled to a temperature of 80° C. or less, for example about 50° C. or lower. The cooled gas from said reflux drum then constitutes a "gaseous stripping effluent" which can optionally be treated then is typically compressed and recycled.

In a first variation of the process of the invention, substantially all of the relatively light hydrocarbon liquid phase is returned to the stripping column as an internal reflux, and thus no light liquid stripping liquid effluent is produced at the reflux drum, or possibly only a very small quantity generally less than 10% by weight of the initial feed, for example a reduced quantity of naphtha or other light products that are often generated during the first step a1).

In said first variation, typically the quantity of liquid stripping effluent is sought to be maximized, recovered from the column bottom and compounds boiling in the desired distillation interval are prevented from leaving the column head either in the form of a light liquid stripping effluent or with the gaseous stripping effluent. Thus, preferably, a relatively low temperature is used in the reflux drum.

The liquid stripping effluent in this first variation thus preferably represents at least 90% by weight and usually about 95% by weight or more of the initial feed.

The aim of this first variation is to subject the largest possible quantity of product boiling in the desired distillation interval to the second hydrotreatment step a3), the main aim usually being to carry out major hydrodearomatization at said second step, applied to the largest possible portion of the treated cut, typically to increase the cetane index by a maximum amount. Step a3), however, also carries out more severe desulphurization of the feed. To carry out this main objective of deep hydrogenation in the second reaction step, then, one or more highly effective hydrogenation catalysts are generally used in step a3), in particular and preferably a catalyst of the noble metal type, for example a platinum on alumina or platinum/palladium on alumina type.

In the first case (platinum catalyst in step a3)), highly severe desulphurization is preferably carried out in step a1), for example to about 100 ppm of sulphur or, as is preferable, about 50 ppm, for example about 10 ppm or less, to limit the quantity of residual sulphur in step a3) because of the high sensitivity of the catalyst to sulphur. As an example, it is possible to use a nickel/molybdenum on alumina type catalyst in step a1). The flowchart for the process of the invention, with loop REC2 separate from loop REC1, can also almost eliminate water at the stripping column (with stripping preferably using makeup hydrogen typically with a substantially zero water content) without reintroducing water to the loop REC2. A very low water content (for example less than about 200 ppm, often less than 100 pm and generally less than 10 ppm) is readily obtained, which is favourable to the activity of the platinum catalyst. When using a purge gas from loop REC1 to loop REC2, it is often preferable with a platinum catalyst to eliminate $H_2S$ from the purge gas and to dehydrate it before introducing it into the REC2 loop.

In the second case (platinum/palladium catalyst in step a3)), less deep desulphurization is optionally carried out in step a1), for example to about 1000 ppm of sulphur or, as is preferable, about 500 ppm, for example to about 100 ppm of sulphur or to a content compatible with good efficiency of the platinum/palladium catalyst used. as an example, it is possible to use a cobalt/molybdenum on alumina type catalyst in step a1). A higher water content than in the preceding case is acceptable in step a3), but in practice almost complete water elimination can readily be achieved by stripping with makeup hydrogen. When using a purge gas from loop REC1 to loop REC2, and a platinum/palladium catalyst in step a3), it is often preferable to eliminate $H_2S$ from that purge gas and/or to dehydrate it before introducing it into the REC2 loop.

Finally, a conventional catalyst (for example of the nickel/molybdenum on alumina type), which is less sensitive to impurities but of lower performance, could be used in step a3).

The supply temperature for the stripping column that can be used in this first variation is typically in the range from about 140° C. to about 270° C., preferably in the range 180° C. to 250° C.

Two typical cases for the operation of the first variation of the process of the invention are given in the Examples (1 and 2).

In a second variation of the process of the invention, which can be used to carry out deep desulphurization of middle distillates, in contrast, the production of a light stripping effluent in large quantities is sought (typically between 10% and 70%, in particular between 20% and 60% by weight with respect to the initial feed), which is evacuated directly downstream (i.e. without complementary hydrotreatment). The design parameters and operating conditions are selected so that this light liquid stripping effluent and the liquid reflux, which typically have identical compositions, constitute a product with a very low (organic) sulphur content at the required specifications (less than 50 ppm, often less than 30 ppm, or even less than 10 ppm, for example about 5 ppm of sulphur). The degree of desulphurization in the first reaction step a1) must in particular be adapted to this very low desired sulphur content for the light liquid stripping effluent. Usually, a 95% distillation point for the light liquid stripping effluent is preferably selected to be 200° C. to 315° C., more preferably between 235° C. and 312° C. to substantially avoid the presence of heavy fractions in the feed, which in many cases comprises sulphur-containing products that are relatively refractory to desulphurization, for example dibenzothiophenes which are fed back to the column bottom.

In this second variation, the second reaction step usually has the principal aim of deep desulphurization of the heavy fractions in the feed. Typically, the liquid stripping effluent (feed for step a3)) has a considerable sulphur content, for example in the range 50 to 2000 ppm, and normally between 100 and 1000 ppm, usually between 100 and about 500 ppm. The principal importance of the production and evacuation of a light stripping effluent in large quantities in this second variation is that this substantially reduces the flow rate of the feed to the second reaction step a3), and thus the required volume for the reactor for said step.

The most appropriate catalysts for step a3) in this second variation of the process of the invention are catalysts adapted for deep desulphurization, in particular platinum/palladium on alumina type catalysts. It is also possible to use conventional catalysts, for example of the nickel/molybdenum on alumina type, or other catalysts that can carry out final desulphurization (at the same time in general as a certain amount of dearomatization of the heavy fraction of the feed, supplied to step a3)).

In this second variation, in the case in which a purge gas is used from loop REC1 to loop REC2, it is also possible to carry out a treatment to eliminate $H_2S$ and/or dehydrate the purge gas before supplying the loop REC2.

The supply temperatures for the stripping column for use in this second variation are typically in the range from about 220° C. to about 390° C., preferably in the range 270° C. to 390° C., and highly preferably in the range 305° C. to 390° C., for example in the range about 315° C. to 380° C. Preferably, a supply temperature for the stripping column is used which may differ by at most 90° C., usually at most 70° C. from the outlet temperature from the first reaction step a1). Generally, the stripping column is supplied after limited cooling (by at most 90° C., usually by at most 70° C.) or without cooling the effluent from the reactor for step a1).

This variation of the process of the invention forms the subject matter of a separate patent application made simultaneously with the present application.

The two variations described above are not limiting and the process of the invention can also be used in other variations and/or for other hydrotreatment objectives and/or catalysts and/or operating conditions. In particular, the catalyst (or catalysts) used in step a1) are not limited to conventional cobalt/molybdenum or nickel/molybdenum on alumina types; the catalyst (or catalysts) used in step a3) are not limited to platinum on alumina or platinum/palladium on alumina or nickel/molybdenum on alumina type catalysts. The process of the invention can be used with any type of hydrotreatment catalyst.

The operating conditions that are suitable for each step, in particular for deep desulphurization in step a1), can be severe: a low hourly space velocity (HSV), a high temperature, a high partial pressure of hydrogen, a catalyst suitable for the feed and for severe conditions. Adequate operating conditions and the choice of an adequate catalyst will depend greatly on the feed that is treated but can readily be determined for a given feed by the skilled person.

A variety of modes can be used to carry out the variations in the process:

As an example, it is also possible to recycle to the inlet to the stripping column (to control the inlet temperature) a further portion of the relatively light hydrocarbon liquid phase recovered from the reflux drum. The scope of the invention also encompasses recycling a portion of the relatively light hydrocarbon liquid phase to the inlet to step a1).

For the second variation of the process, it is also possible to cool the column head vapours in two steps:

- an initial cooling with partial condensation of the column head vapours followed by gas/liquid separation in a reflux drum and, for example, returning all of the condensed liquid to the column, the temperature in this drum being in the range 70° C. to 250° C., for example, and such that a large quantity of the hydrocarbons remains in the gas from said separator drum;
- complementary cooling of the gas from said latter separator drum with or without contact with a liquid (for example the hydrotreated liquid fraction) that is capable of absorbing light hydrocarbons, to condense and evacuate the light liquid stripping effluent alone or as a mixture.

The flow rates for the liquid reflux and stripping gas depend strongly on a number of parameters including the temperature of the supply to the stripping column, for example. Preferably, said parameters are selected in a coordinated manner. Generally, a stripping gas flow rate in the range 2.5 to 520 $Nm^3/m^3$ of feed supplied to step a1) is used, usually in the range 5 to 250 $Nm^3/m^3$ of feed supplied to step a1). Preferably, this flow rate corresponds to a hydrogen flow rate in the range 5% to 150%, preferably 10% to 100% of the flow rate of the hydrogen consumed in step a1) (assuming all of the stripping gas is consumed). The quantity of liquid reflux is generally in the range 0.05 to 1.2 kg/g of liquid feed supplied to step a1), and usually in the range 0.15 to 0.6 kg/g of liquid feed supplied to step a1). Suitable stripping gas and liquid reflux flow rates can readily be determined by the skilled person for the desired separation conditions by computer simulation of the fractionation.

In an optional preferred disposition of the process of the invention, washing water is injected into the vapours at the stripping column head, upstream of the cooling exchanger or exchangers (and/or an air-cooled exchanger) to capture nitrogen-containing compounds, for example ammonia and ammonium sulphide formed in the reactor; the aqueous phase, containing a large portion of these undesirable compounds, is preferably recovered downstream in a gas/liquid separator drum also functioning as a decanter, then evacuated.

The process of the invention can also be carried out with a variety of modifications and in a variety of implementations.

In a highly preferable variation of the process which produces a light liquid stripping effluent, a substantially desulphurized light product is produced. Optionally, if the light liquid stripping effluent does not completely satisfy the required specifications, it is possible for it to undergo complementary less severe hydrotreatment to bring it to the required specifications.

In one implementation of the process, each of loops REC1 and REC2 is supplied with makeup hydrogen in a quantity adapted to the hydrogen consumption in said loop. The two loops can then operate without a purge gas.

In a further implementation of the process of the invention, an excess of makeup hydrogen with respect to the hydrogen requirement in step a3) is supplied to step a3) at at least one point in the loop REC2, and a hydrogen-rich purge gas flow (corresponding to the excess hydrogen) is extracted from the loop REC1. Advantageously, all or part of the purge gas can be used as a stripping gas in step a2): this purge gas, which is substantially free of impurities as it derives from loop REC2, provides an additional stripping gas which can advantageously be introduced into the column at an intermediate position, below the inlet for the effluent from step a1), and above the (optional) inlet for the higher purity external stripping gas (makeup hydrogen).

This purge for the loop REC2 can, in this implementation of the process of the invention, represent 10% to 100% , in particular 30% to 100% of the hydrogen requirements for the loop REC1. In the case in which said purge represents 100% of the hydrogen requirements for the loop REC1, the loop REC1 is only supplied with makeup hydrogen via the purge for the loop REC2.

Finally, in a further implementation, loop REC1 can be supplied with excess makeup hydrogen and the purge gas can be evacuated to the loop REC2, preferably after eliminating $H_2S$ and usually after dehydration.

In general, the process of the invention can advantageously comprise a step a5) for contact (or contacting) at least a portion of the hydrotreated liquid fraction from step a4) with at least a portion of the gas stream moving in the loop REC1. The effluent from said step a5) is then separated into a liquid contacting effluent and a gaseous contacting effluent; at least a portion of this gaseous contacting effluent is then recycled to the loop REC1.

Contact allows the liquid from the second hydrotreatment reaction step (step a3)) to be used after gas/liquid separation as an adsorbent for light hydrocarbons containing 1 to 4 carbon atoms (C1, C2, C3, C4) contained in the gas from the loop REC1, and to increase the hydrogen purity of said loop REC1: step a3), the supply for which has been stripped, and which produces relatively few light compounds, operates with a high hydrogen purity, and the liquid from this step constitutes a good adsorbent for light hydrocarbons.

The process can also comprise a treatment for eliminating at least part of the $H_2S$ contained in at least part of the gaseous stream moving in the loop REC1, said treatment being carried out at a point in the loop REC1 located generally downstream of the stripping step a2) and upstream of the contact step a5). Said treatment can consist of gas washing with an amine solution, a technique that is well known to the skilled person, or $H_2S$ elimination using another process that is known to the skilled person. Such treatments are, for example, shown in EP-A-1 063 275.

It is also possible with the process of the invention in some cases (for example when the sulphur content in the feed is not too high or if a relatively low hourly space velocity is used in step a1), which can compensate for a high sulphur content in the recycle gas to the loop REC1), not to use a $H_2S$ elimination treatment by amine washing the recycle gases moving in the facility. In this case, the process will, however, comprise one or more treatments to eliminate at least part of the $H_2S$ contained in the recycle gases moving in loops REC1 and REC2, in which each of the treatment or treatments is constituted by a combination of a step for contact of at least a portion of the recycle gas moving in the loop REC1 with a hydrocarbon liquid fraction, to carry out limited $H_2S$ absorption by this liquid hydrocarbon fraction, followed by a step for gas/liquid separation of the mixture deriving from this contact and direct evacuation of at least a portion of the separated liquid (downstream of the process, i.e. with no complementary hydrotreatment). The liquid hydrocarbon fraction which can absorb (and evacuate) $H_2S$ can optionally be a portion of the relatively light hydrocarbon liquid phase (typically recovered at the reflux drum) and/or usually all or part of the hydrotreated liquid fraction. The term "($H_2S$ elimination) treatment" as used in this disposition of the process must be taken in its general sense, thus comprising simple contact with a liquid phase to absorb $H_2S$ by liquid/vapour equilibrium, and not only chemical or physico-chemical treatments such as amine washing. Contact can also be achieved by partial condensation of a hydrocarbon liquid phase and not solely by contacting with all or part of the hydrotreated liquid fraction. In other words, this (optional) disposition of the process means that it is possible to use hydrotreatment in two or more steps with intermediate pressurized hydrogen stripping, which can optionally include the use of a noble metal catalyst (for example of the platinum or platinum/palladium on alumina type) in the second and/or last step, without amine washing of a portion of the recycle gas. Typically, neither the recycle gas nor the hydrogen makeup or makeups is treated by amine washing in this optional disposition of the process of the invention.

The $H_2S$ contained in the gas from the REC1 loop (produced in step a1)) is then evacuated by contact of said $H_2S$-rich gas with the liquid hydrocarbon fraction, to absorb $H_2S$ which is then evacuated with the liquid product to the stripper downstream of the process. This absorption with an internal hydrocarbon liquid is less efficient than amine washing and results in a higher amount of $H_2S$ in the recycle gas for the loop REC1. in contrast, it avoids the use of an expensive circuit for circulating and regenerating an amine solution.

The loop REC2, which is separate from REC1 in the process of the invention, means that a $H_2S$ content which remains relatively high in loop REC1 in the absence of any amine washing is not reflected to loop REC2. Thus, a noble metal type catalyst can readily be used in step a3). In contrast, the processes of the prior art with two hydrotreatment steps and an integrated hydrogen stripper all require amine washing.

The loop REC1 often contains water because of an injection of washing water and/or the presence of water in the feed. Because makeup hydrogen, which is generally substantially free of water, is preferentially (and often exclusively) used as a stripping gas (and/or if not, a gas with a very low water content, for example less than 5 ppm), then typically very good water elimination of the stripping liquid effluent is obtained. In the case in which a purge is used from loop REC1 to loop REC2, it is preferable to eliminate $H_2S$ from this purge gas, but also usually to dehydrate it, using techniques that are known to the skilled person, for example on a molecular sieve or other solid adsorbent, or by washing with a dessicant liquid, for example diethyleneglycol or triethylene glycol, or any other known dehydration process. The need for said dehydration and the desired degree of dehydration essentially depend on the sensitivity to water of the catalyst for step a3) (typically high for platinum catalysts, medium for platinum/palladium catalysts, and low for conventional catalysts with no noble metal). Suitable conditions for (optional) dehydration can readily be determined by the skilled person.

A further aim of the stripping step, apart from at least partial elimination of many impurities, is to remove by stripping a substantial portion of the light hydrocarbons containing 1 to 4 carbon atoms (C1 to C4) present in the liquid effluent from step a1), prior to step a3). This can produce a purity Pur2 of hydrogen in loop REC2 that is greater than the purity Pur1 of the hydrogen in the loop REC1. As an example, it may be possible to have a Pur2/Pur1 ratio of more than 1.06, in particular more than 1.08 and usually more than 1.10.

By way of non limiting example, the following ranges of purity can be obtained:

With a makeup hydrogen purity of 92, it is generally possible to obtain a purity in the range about 58 to 84, and often in the range about 60 to 80 in the loop REC1, while the hydrogen purity in loop REC2 can generally be in the range about 73 to 90, and often in the range about 75 to 88.

With a makeup hydrogen purity of 99.9, it is generally possible to obtain a purity in the range about 73 to 90, and usually in the range 75 to 88 in the loop REC1, while the purity of the hydrogen in the loop REC2 can generally be in the range about 88 to 99.5, and usually in the range 90 to 99.

In a further variation of the process of the invention, separate makeup hydrogen streams (external to the two loops) with different purities are supplied to the two loops REC1 and REC2. Preferably, loop REC2 is supplied with a stream of makeup hydrogen with higher purity than that of the stream of makeup hydrogen supplying the loop REC1. As an example, the purity of the makeup hydrogen for the loop REC1 is about 92 or in the range 88 to 96, and derives at least in part from a catalytic reforming unit, and the purity of the hydrogen makeup for loop REC2 is 99.9 or more and derives from a steam reforming unit followed by a step for separation (purification) on a molecular sieve or on a further bed of solid adsorbent, known to the skilled person as PSA (pressure swing adsorption). The differences in purity can be lower if the makeup used is one or two mixtures of gas with different purities, for example of the type cited above, with different percentages for each of the makeups.

A further technical advantage of the process of the invention is to use loops and reaction steps that are optionally at very different pressures, which means that the pressure can be adjusted, in particular in the second hydrotreatment step a3), to the optimum desired level.

This is interesting both for new units and for revamping existing units, for example by adding a supplementary reaction step a3).

It is possible to use a pressure in step a3) that is higher by at least 1.2 MPa and at most 12 MPa than that in step a1), in particular higher by at least 1.2 MPa and at most 4.5 MPa than that in step a1).

Regarding the partial pressures of hydrogen in the two loops (by convention at the outlet from the reactor in both cases), it is possible to use a partial pressure of hydrogen in step a3) that is greater by at least 1.35 MPa and at most 13.5 MPa than that of step a1), in particular greater by at least 1.35 MPa and at most 5 MPa than that of step a1).

However, it is also possible to use closer partial pressures of hydrogen, for example a partial pressure of hydrogen in step a3) greater than that in step a1) by a value in the range 0 to 1.35 MPa, in particular in the range 0.1 to 1.35 MPa.

It is also possible to use a pressure in step a3) that is substantially equal to or lower by at least 0.1 MPa than that in step a1). In such a case, it is nevertheless often possible to use a partial pressure of hydrogen in step a3) that is higher, for example by at least 0.1 MPa, than that in step a1), because of the greater purity of the loop REC2.

The invention also concerns any hydrocarbon cut from the group formed by gas, jet fuel, kerosene, diesel fuel, gas oil, vacuum distillate, and deasphalted oil containing at least one fraction hydrotreated using the process of the invention.

Figure 2:
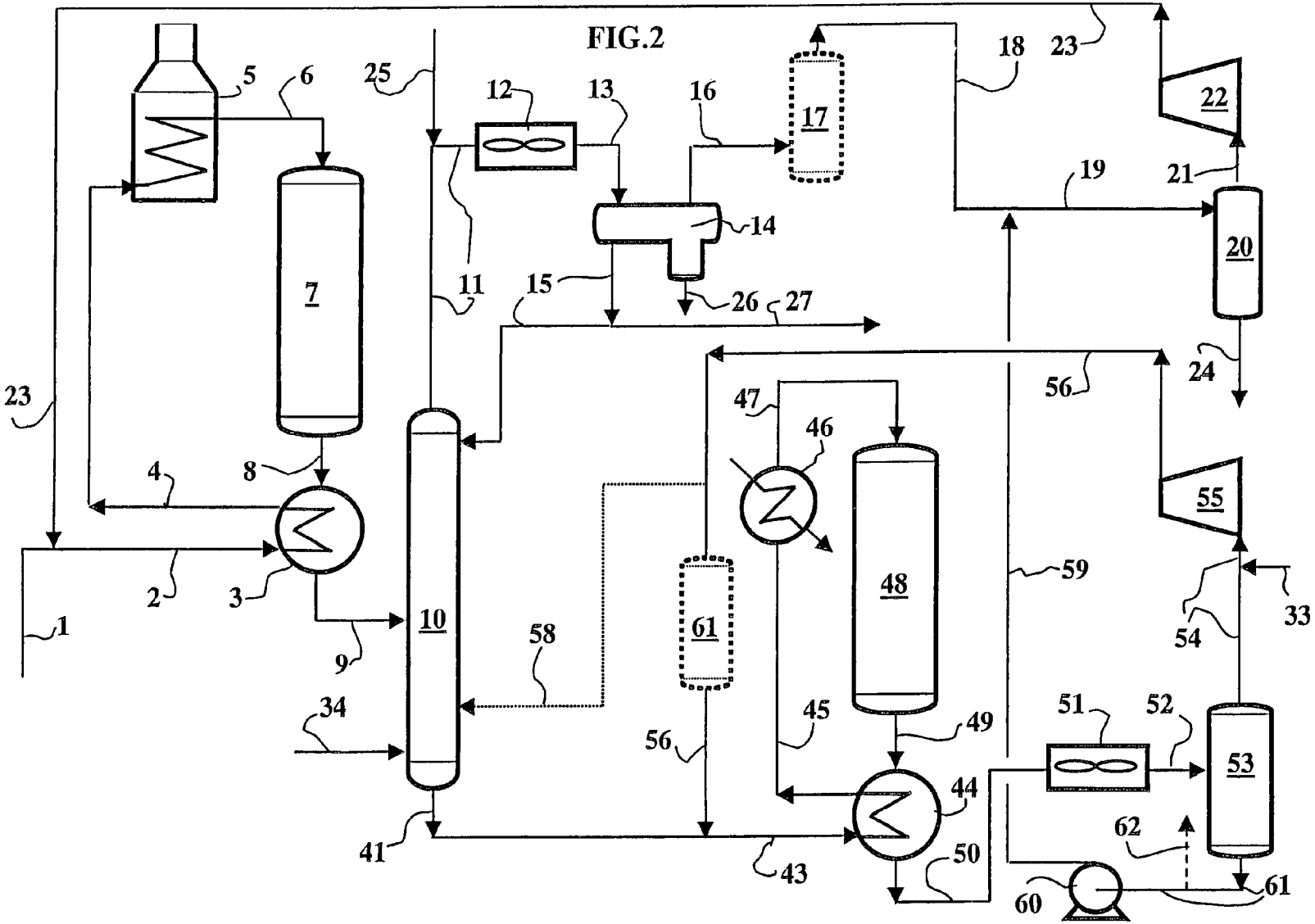

Two implementations among the preferred implementations of the process of the invention are shown in FIGS. 1 and 2.

FIG. 1 shows a flow chart for a hydrotreatment facility for carrying out a first variation of the process of the invention:

The hydrotreatment facility feed, for example a straight run middle distillate type cut containing a high proportion or even 100% of light cycle oil (LCO), is supplied via a line 1 and supplemented with a hydrogen-rich recycle gaseous stream moving in line 23. The mixture formed moves in line 2 and is reheated in the feed/effluent heat exchanger 3 (and often in a heat exchanger with the effluent from step a3), this exchanger not being shown), then sent via line 4 to a furnace 5 in which its temperature is heated to the required temperature for the first reaction step a1). At the outlet from furnace 5, the reaction mixture moves in line 6 then supplies the hydrotreatment reactor 7 which is typically a fixed catalytic bed downflow reactor. The effluent from said reactor 7 (carrying out first reaction step a1)) is then sent via a line 8 to the feed/effluent exchanger 3 then supplied to a stripping column 10 via a line 9.

This column is also supplied with two sources of hydrogen-rich stripping gas which are supplied via lines 34 and 58: the gas supplied via line 34 is typically makeup hydrogen, of medium or possibly high purity, and preferably substantially free of impurities such as $H_2S$ and/or water vapour. This gas can, for example, derive from a catalytic reforming unit and/or a steam reforming unit.

The second stream of stripping gas supplied via a line 58 is optional. Said stream derives from a possible excess of hydrogen-rich gas (makeup) supplied to step a3); the excess can then (in particular) be used as the stripping gas supplied via line 58. This use of excess makeup hydrogen in reaction step a3) increases the purity of the recycle gas in this step.

The stripping column can also be supplied from other sources of stripping gas, not shown in FIG. 1; in particular, in some cases stripping gas (if sufficiently pure) taken from the recycle gas moving in line 23 could be supplied, being introduced into the column at or just above the supply of the purge gas for the REC2 loop via line 58.

In general, the stripping gas or gases supplying the column 10 may previously have been dried in a dryer (optional, not shown) to substantially eliminate water from the stripping step (more particularly if the catalyst from hydrotreatment step a3) contains a noble metal which is highly sensitive to water).

In general, the stripping gas or gases supplying the column 10 may also have been purified to eliminate any traces of $H_2S$, for example by adsorption on a zinc oxide bed (optional, not shown), to more completely eliminate $H_2S$ in the stripping step (more particularly if the catalyst for hydrotreatment step a3) contains a noble metal which is highly sensitive to $H_2S$, for example a platinum catalyst).

This purification of the stripping gas is, however, generally not necessary if the stripping gas is makeup hydrogen deriving from a catalytic reformer. In the case in which the makeup hydrogen is at least partially produced by steam reforming, then preferably, after steam reforming, almost complete elimination of compounds other than hydrogen is preferably carried out on a molecular sieve (PSA type separation) which produces very high purity hydrogen.

The vapours from the head of column 10 move in line 11 and are supplemented with washing water supplied via a line 25, and are then cooled with partial condensation in the air-cooled exchanger 12 then transferred via a line 13, prior to being separated in the gas/stripping step liquid separator drum 14, which also acts as a decanter and a reflux drum. Said drum 14 carries out separation between three phases:

- a gas stream or "gaseous stripping step effluent" sent to line 16;
- a relatively light hydrocarbon liquid phase extracted via line 15. A first portion of said liquid phase is recycled to the column 10 as a liquid reflux, still via line 15; the (optional) residual liquid fraction or "light liquid stripping effluent" is evacuated downstream via a line 27 (optional), preferably downstream (i.e. it is not treated in reaction step a3));
- an aqueous liquid phase also containing nitrogen-containing impurities, evacuated via line 26.

The liquid at the column bottom 10 or "stripped liquid effluent" (or "heavy stripped liquid effluent" if there is a light liquid stripping effluent) is sent to the second reaction step a3) via a line 41.

The gaseous stripping effluent moving in line 16 optionally traverses the equipment 17 to at least partially eliminate the $H_2S$ contained in that gas. That equipment 17 can typically be a washer, or $H_2S$ absorber using a solution of amines (inlet and outlet for the amine solutions are not shown); it can also be a further device for eliminating $H_2S$ and/or a device for eliminating $H_2S$ and water. That equipment 17 is optional (its use depends on a number of parameters, in particular on the sulphur content in the feed, and on the space velocity used in the first reactor 7, which if it is sufficiently low can allow the desired desulphurization in the first step a1) without amine washing in the REC1 loop).

At the outlet from said equipment 17, the gas moves in a line 18 and is supplemented with a stream of "hydrotreated liquid fraction" moving in a line 59, then rejoins the gas/liquid separator drum 20 via line 19 in which in-line mixing occurs. This can absorb light hydrocarbons into the liquid phase and increases the purity of the recycle loop REC1.

The liquid effluent from drum 20 or "liquid contacting effluent" is evacuated via a line 24and constitutes a liquid effluent from the hydrotreatment facility (a further (optional) effluent, the "light liquid stripping effluent", is optionally evacuated via line 27).

The gas separated in drum 20 or "gaseous contacting effluent" is sent via a line 21 to a compressor 22 for the recycle gas, then recycled to the inlet to reaction step a1) via line 23.

The stripped liquid effluent moving in line 41 is pumped through the pump 40 to bring its pressure to a sufficient value for reaction step a3), said pressure in this example being higher than that in step a1). At the discharge from pump 40, the liquid is supplemented with hydrogen-rich gas supplied via a line 56 then moves in a line 43, traversing the feed/effluent exchanger 44, then moving in a line 45 and is heated (again) in the exchanger (or furnace) 46, then rejoins the reactor 48 for reaction step a3) via a line 47. At the outlet from said reactor, the effluent transits via a line 49, traverses exchanger 44, moves in line 50, is cooled in air-cooled exchanger 51 then moves in a line 52 to reach the gas/liquid separator drum 53, the liquid fraction (hydrotreated) is sent to line 59 for mixing with the gas moving in line 18 of the loop REC1, and the gaseous fraction is sent via a line 54 to the gas recycle compressor 55. Optionally, a portion of said gaseous fraction (possible excess gas, i.e., any purge gas in the hydrogen recycle loop for step a3)) is removed and sent via the (optional) line 58 to the lower portion of the stripping column 10 (and/or optionally to a further point in the loop REC1 via means that are not shown).

A makeup hydrogen stream supplied via line 33 is then added to the residual gas stream moving in line 54 upstream of the compressor 55. The recycle gas, after said makeup hydrogen addition, is then compressed in the compressor 55 and recycled to the inlet to the reaction step a3) via a line 56.

This makeup hydrogen can be constituted by hydrogen deriving from a catalytic reforming unit and/or steam reforming unit (usually naphtha or a natural gas). Optionally, hydrogen with a purity that is higher than that of the hydrogen supplied via line 34 can be supplied via line 33. This high purity hydrogen can derive from a PSA type separation unit which may deliver hydrogen with a purity that is usually greater than 99.9. This can increase the purity and partial pressure of the hydrogen in the loop REC2.

In the facility of FIG. 1, the recycle loop REC1 of step a1) comprises the elements referred to hereinafter, following the "gas path": 21, 22, 23, 2, 3, 4, 5, 6, 7, 8, 3, 9, 10 (upper portion of the column located above the supply 9, the supplied gas rising in the column), 11, 12, 13, 14, 16, 17, 18, 19, 20, and 21) again, which closes the loop.

The recycle loop REC2 of step a3) comprises the following elements: 54, 55, 56, 57, 43, 44, 45, 46, 47, 48, 49, 44, 50, 51, 52, 53 and 54, which closes the loop.

It can be seen that in the process of the invention, said two recycle loops have no common portions and no mixing points. Loop REC2 of the facility of FIG. 1 is exclusively supplied with external makeup hydrogen (via line 33) which avoids polluting it with the impurities that are often present in the loop REC1.

If excess makeup hydrogen (hydrogen-rich gas) is supplied to the loop REC2 via line 33, depending on the hydrogen requirement in reaction sep a3), the excess gas can advantageously be used as the stripping gas for column 10 (evacuated from the loop REC2 via line 58), this gas being substantially free of impurities. The supply of excess makeup gas to the loop REC2 results in increased purity of the gas in loop REC2 as the purge extracts light hydrocarbons containing 1 to 4 carbon atoms and traces of residual $H_2S$ from said loop.

Optionally, for example if the loop REC2 functions with a quantity of purge gas exceeding the requirements of the stripping gas, a fraction or even all of the purge gas for the loop REC2 can optionally be sent by means that are not shown to a point in the loop REC1 (for example of line 23) without passing via the stripping column.

In the facility of FIG. 1, the two loops REC1 and REC2 are supplied with makeup hydrogen (hydrogen-rich gas) via lines 34 and 33 respectively.

The two streams of makeup hydrogen can be of different purities. The hydrogen supplied via line 34 to loop REC1 can optionally derive from a catalytic reformer and be of medium purity, for example between 88 and 96. The hydrogen supplied via line 33 to loop REC1 can optionally and preferably derive from a steam reforming unit followed by PSA type separation and be of very high purity, for example 99.9.

The two loops REC1 and REC2 could, however, be supplied from a common line, not shown, using makeup hydrogen of identical purity.

The facility can also comprise other elements that are not shown in FIG. 1, for example:

- one or more quench gas lines originating from points on line 23 and supplying the reactor 7 at an intermediate position (in one or more zones each located between two consecutive catalytic beds);
- one or more stripping gas supplies for the column 10 deriving from one or more points on line 23 or line 21.

These additional lines could then be included in the loop REC1.

The facility can also comprise a line for evacuating purge gas from a point in the recycle loop REC1 and/or a line for introducing makeup hydrogen at a point in this loop REC1 without passing via the stripping column (for example at line 23).

In the same manner, the loop REC2 could comprise elements that are not shown in FIG. 1, for example one or more quench lines deriving from points in line 56 and supplying the reactor 48 at an intermediate position (zones between catalytic beds). The facility can also comprise evacuating purge gas from a point in the loop REC2 without it supplying the loop REC1.

The scope of the invention encompasses adding and/or removing heat exchangers or equivalent equipment and/or organizing the thermal integration of the facility in a different manner. As a non limiting example, the exchanger 46 in loop REC2 could be the furnace 5 itself (or a portion of that furnace, in particular a portion of the furnace convection zone). It is also possible, and often done, to preheat the feed for step a1) and/or the makeup hydrogen with the effluent from step a3) and/or to preheat the recycle gas from the loop REC2 with the effluent from step a3) and/or to recover heat from the head effluent from column 10 upstream of the air cooled exchanger 12.

The effluent from the reactor for step a1) can be cooled in an exchanger (or a plurality of exchangers). Cooling (for all of the exchangers if a plurality of exchangers is used) can be substantial, for example usually in the range about 90° C. to 200° C. in the first variation of the process of the invention. It can also be limited, usually to at most 90° C., generally at most 70° C. in the second variation of the process of the invention, to keep the temperature high at the inlet to the stripping column. This effluent can also be reheated in a limited manner in a furnace prior to supplying the stripping column. The stripping liquid effluent (or heavy stripping liquid effluent) can optionally be reheated in a heat exchanger and/or a furnace before supplying the reactor for reaction step a3), or it can be cooled in a limited manner prior to supplying the reactor. The stripping column 10 can also comprise a reboiler for the liquid at the column bottom, not shown in FIG. 1. In some cases, the effluent from the reactor 7 for step a1) can be supplied directly to the stripping column (with no heat exchange) and/or the reactor for step a3) can be directly supplied (with no heat exchange) by the stripping liquid effluent.

The skilled person could also use other heat exchanges between a plurality of streams moving in the facility, depending on the respective temperatures of the different streams .

The scope of the invention also encompasses modifying the position of the $H_2S$ purification equipment 17, that equipment then being located downstream of the compressor 22 (on line 23).

The scope of the invention also encompasses one or each of the two reaction steps a1) and a3) being carried out not in one but in two or even more reactors in series, optionally with intermediate adjustment of the temperature, or if one reactor comprised a plurality of reaction zones in series, with identical or different catalysts.

The hydrotreatment reactors (7, 48) are typically reactors with a fixed catalytic bed and a downflow for the gas and liquid. The scope of the invention encompasses whether one or more of the reactors is of a further type or a plurality of other types, in particular of the moving bed type or an ebullated bed type (because of introduction of the gas) or a fluidized bed type (fluidized by the recycle gas), or with a fixed or moving bed in upflow mode for the gas and downflow mode for the liquid.

FIG. 2 shows a flowchart for a further hydrotreatment facility for carrying out a process according to a second variation of the process of the invention, using the same reference numerals for elements common to FIGS. 1 and 2:

The first difference with the facility of FIG. 1 concerns the pumping means linked to the pressures of the different reaction steps. In contrast to the facility of FIG. 1, the facility of FIG. 2 uses a pressure in step a3) that is lower than in step a1). There is thus no need for a pump to transfer liquid stripping effluent via line 41. In contrast, a pump 60 is used to transfer at least a portion of the hydrotreated liquid fraction moving in line 61 to the step a5) for contact with the recycle gas of loop REC1, via line 59. A further portion of the hydrotreated liquid fraction can optionally be evacuated directly downstream (without contact) via line 62.

A further difference concerns the point for removing purge gas (optional) evacuated via line 58. This point is displaced downstream of the recycle compressor 55 to facilitate return of the purge gas to the loop REC1(the pressure balance being different in the facility of FIG. 2). If the pressure in the loop REC2 in particular at the discharge of the compressor 55 is lower than that at all points in the loop REC1, it is generally preferable not to sent the purge gas from the loop REC2 to the loop REC1, which would necessitate a supplemental compressor (except if a common compressor were to be used, which would be necessary for a further use, for example to supply a makeup gas to the loop REC1 ).

Finally, the loop REC2 comprises, disposed on line 56, optional equipment 61 for purifying the recycle gas to eliminate traces of $H_2S$ if necessary, for example a zinc oxide adsorbent bed. This bed can optionally operate at a higher temperature than the outlet temperature for the recycle compressor by using a reheater, not shown. The adsorbent bed 61 could also be integrated into the reactor 48.

In the case in which the catalyst for step a3) is not or is very slightly sensitive to water, for example with the conventional catalyst with no noble metal, the optional equipment 61 for purifying the recycle gas can comprise a washing column using an aqueous amine solution.

These variations in the process with $H_2S$ purifier 61 are not connected with staggering the pressures between steps a1) and a3); thus, they can also be used in the facility of FIG. 1.

The other elements of FIG. 2 are identical to those of FIG. 1. For the facility of FIG. 2, it is also possible to use options or technical modifications such as those described for the facility of FIG. 1 without departing from the scope of the invention.

In general, the facility for hydrotreatment of a hydrocarbon feed to carry out the process of the invention comprises:

- a first hydrogen recycle loop REC1, said loop comprising at least one first hydrotreatment reactor 7 connected downstream to a column 10 for pressurized stripping of the liquid effluent from the reactor using a hydrogen-rich gas, the head of the column 10 being connected to a means 12 for cooling and partial condensation of the gas stream deriving from the column 10, said cooling and partial condensation means being connected downstream to a first gas/liquid separator 14, itself connected to the intake of a first recycle compressor 22, the discharge from said first compressor being connected to a first hydrotreatment reactor 7;
- a second hydrogen recycle loop REC2, separate from the loop REC1, said loop comprising at least one second hydrotreatment reactor 48, said reactor being connected upstream to the bottom of the stripping column 10, for hydrotreatment of the liquid effluent issuing from the bottom of the stripping column 10, and connected downstream to a second gas/liquid separator 53, itself connected to the intake for a second recycle compressor 55, the discharge from said second compressor being connected to the second hydrotreatment reactor 48.

Preferably, the loop REC2 is supplied with hydrogen via one or more supply means 33, each of said supply means 33 being connected upstream exclusively to one or more external sources of hydrogen.

The facility can also comprise at least one line 58 for supplying a stream of purge hydrogen from the loop REC2 to the loop REC1, said line being connected upstream to a point in the loop REC2 and downstream to a point in the loop REC1.

The facility can also comprise a first means 34 for supplying an external makeup hydrogen stream with a relatively low purity to loop REC1, and a second means for supplying an external makeup hydrogen stream with a relatively high purity to loop REC2.

Preferably, the stripping column comprises above its supply point a rectification zone having a separation efficiency of at least 1 theoretical plate, for example in the range 2 to about 20 theoretical plates, and usually in the range 4 to 15 theoretical plates, limits included.

The facility can also comprise a line 27 for downstream evacuation of a light liquid stripping fraction, said line being connected upstream to the first gas/liquid separation means 14.

The various supply and/or evacuation means mentioned in this description typically comprise at least one line and can also comprise one or more valves and/or measuring means and/or regulating means, for example for the flow rate and/or temperature.

EXAMPLES

The following examples provide non limiting explanations of the operating conditions used in the process of the invention:

Example 1

Feed treated: light cycle oil (LCO) with the following characteristics:

- distillation interval (5%-95% distilled): 205-347° C.;
- density: 0.91;
- sulphur content: 4000 ppm;
- nitrogen content: 800 ppm;
- aromatics content: 60% by weight;
- cetane index: 28;
- purity of makeup hydrogen: 92.5.

Operating Conditions in First Step a1) and First Loop REC1:

- catalyst: HR448, Co—Mo on alumina, sold by AXENS (formerly PROCATALYSE);
- mean reactor temperature: 380° C.;
- reactor outlet pressure: 9.8 MPa;
- $H_2$ partial pressure, reactor outlet: 6.2 MPa;
- HSV (hourly space velocity): 0.6 $h^{-1}$;
- hydrogen (reactor inlet+quench): 625 $Nm^3/m^3$ of feed;
- hydrogen consumed in step a1): 2.03% by weight with respect to feed;

Operating Conditions in Step a2):

- stripping column inlet temperature: 220° C.;
- stripping column inlet pressure: 9.5 MPa;
- number of theoretical plates above supply: 9;
- number of theoretical plates below supply: 15
- reflux ratio with respect to hydrocarbon feed for column: 0.25 kg/kg/;
- stripping hydrogen: flow rate corresponding to 95% of hydrogen consumed in first step;

Operating Conditions for Second Reaction Step a3) and Second Loop REC2:

- catalyst: LD 402 catalyst, platinum on alumina, sold by AXENS (formerly PROCATALYSE). This catalyst has a high hydrogenation efficiency and step a3) is essentially hydrogenation;
- mean reactor temperature: 300° C.;
- reactor outlet pressure: 8.5 MPa;
- partial pressure of $H_2$, reactor outlet: 6.8 MPa;
- HSV: 7.0 $h^{-1;}$
- hydrogen (inlet+quench): 700 $Nm^3/m^3$ of feed for step a3);
- hydrogen consumed in step a3): 1.10% with respect to feed for step a1).

Results:

At the end of the first step, the feed contained 10 ppm of sulphur, 5 ppm of nitrogen and 27% by weight of aromatics.

At the end of the stripping step, about 99% by weight of the fraction of feed boiling above 150° C. was recovered from the bottom of the stripping column. The facility of Example 1 thus functioned in accordance with the first variation of the process of the invention.

The final product, fractionated at the facility outlet, had the following characteristics:

Density: 0.84;

sulphur content: 5 ppm;

nitrogen content: 1 ppm;

aromatics content: 5% by weight;

cetane index: 48;

distillation interval(5-95%): 195-337° C.

Example 1 used a higher pressure in the first reactor than in the second reactor. This example can thus be carried out in a facility of the type shown in FIG. 2. The preceding results correspond to a facility flowchart such as that shown in FIG. 2 but retaining step a5) for contact upstream of the gas/liquid separator 20 as indicated in FIG. 1. In example 1, all of the relatively light hydrocarbon liquid phase separated in the gas/liquid separator 14 was used as a reflux in the stripping column.

The purity of the hydrogen at the outlet from the reactor for the first step a1) was 63.26, while it was 80 at the outlet from the reactor for the second reaction step a3). This resulted in a partial pressure of 6.8 MPa at the outlet from the reactor for step a3) that was higher than the partial pressure of hydrogen at the outlet from the reactor for the first step a1), which was 6.2 MPa, while the order was reversed for the total pressures.

The feed supplied to step a3) was completely free of impurities such as $H_2S$, $NH_3$, $H_2O$ (less than 5 ppm for each of these compounds) and more than 99% by weight of the light hydrocarbons containing 1 to 4 carbon atoms present at the outlet from step a1).

Example 2

Feed: identical to that of Example 1.

The facility was designed to obtain the same quality of feed after the first step and the same final product as in the facility of Example 1. This facility also carried out stripping with column bottom recovery of about 99% by weight of the fraction boiling above 150° C., and also functioned in accordance with the first variation of the process of the invention.

Purity of makeup hydrogen: 99.999.

Operating Conditions in First Step a1) and First Loop REC1:

catalyst: HR448, Ni—Mo on alumina, sold by AXENS (formerly PROCATALYSE);

mean reactor temperature: 380° C.;

reactor outlet pressure: 7.3 MPa;

$H_2$ partial pressure, reactor outlet: 5.8 MPa;

HSV (hourly space velocity): 0.55 $h^{-1}$;

hydrogen (inlet+quench): 625 $Nm^3/m^3$ of feed;

hydrogen consumed in step a1): 2.03% by weight with respect to feed;

Operating Conditions in Step a2):

stripping column inlet temperature: 220° C.;

stripping column inlet pressure: 7.0 MPa;

number of theoretical plates above supply: 9;

number of theoretical plates below supply: 15 reflux ratio with respect feed to facility (liquid reflux/step a1 feed): 0.25 kg/kg/;

stripping hydrogen: 95% of hydrogen consumed in step a1);

Operating Conditions for Second Reaction Step a3) and Second Loop REC2:

catalyst: LD 402 catalyst, platinum on alumina, sold by AXENS (formerly PROCATALYSE);

mean reactor temperature: 300° C.;

reactor outlet pressure: 7.6 MPa;

partial pressure of $H_2$, reactor outlet: 7.2 MPa;

HSV: 7.5 $h^{-1}$;

hydrogen (inlet+quench): 700 $Nm^3/m^3$ of feed for step a3);

hydrogen consumed in step a3): 1.10% with respect to feed for step a1).

Example 2 used a higher pressure in the second reactor than in the first reactor. Thus, this example could be carried out in a facility of the type shown in FIG. 1.

The hydrogen purity at the outlet from the reactor for the first step a1) was 79.45, while it was 94.73 at the outlet from the reactor for the second reaction step a3).

This example is not limiting and it is possible, for example, to have lower pressures in step a1), for example absolute pressures in the range 3.8 to 6.2 MPa, while the pressure in step a3) could be higher by 1.2 to 4.5 MPa, for example at that of step a1). If the pressure in step a1) is relatively low, and the feed for step a3) still contains substantial traces of sulphur, it is possible to use in step a3) catalysts with two noble metals, or compounds of noble metals, for example of the platinum/palladium on alumina type and/or any type of catalyst that is resistant to traces of sulphur (and/or eliminate said traces of sulphur in the loop REC2 ).

For a variety of feeds and product specifications, the process of the invention can very effectively eliminate all of the pollutants present in the first hydrotreatment step and allows the us of the best available catalysts in an optimal manner in the second step (high partial pressure of hydrogen and minimal impurities content), with high energetic efficiency, without necessitating consumption of stripping vapour.

The invention claimed is:

1. A process for hydrotreating a hydrocarbon feed containing sulphur-containing compounds, comprising the following steps:

a first step a1) for hydrotreatment in which said feed and excess hydrogen are passed over a first hydrotreatment catalyst to convert at least a portion of the sulphur contained in the feed into $H_2S$;

downstream of step a1), a step a2) for stripping the at least partially desulphurized feed from step a1) in a pressurized stripping column, using at least one hydrogen-rich stripping gas, to produce at least one hydrogen-rich gaseous stripping effluent and at least one liquid stripping effluent, the gaseous stripping effluent being at least partially compressed and recycled to the inlet to the first step a1) using a first recycle loop REC1;

downstream of step a2), a second hydrotreatment step a3) in which the stripped liquid effluent and excess hydrogen are passed over a second hydrotreatment catalyst, the effluent from said step a3) being fractionated, in a gas/liquid separation step a4), into a hydrogen-rich gaseous fraction and a hydrotreated liquid fraction, said hydrogen-rich gaseous fraction being at least partially compressed and recycled to the inlet to step a3) using a second recycle loop REC2 separate from the loop REC1, in which the loop REC2 is supplied with hydrogen independently of the loop REC1, via one or more streams of hydrogen exclusively constituted by streams of makeup hydrogen external to the loop REC1, such that a flow of excess makeup hydrogen compared with the hydrogen recquirements of step a3) is supplied to step a3), and wherein stream of hydrogen-rich purge gas is extracted from the loop REC2 and said stream is sent to at least one point in the loop REC1.

2. A process according to claim 1, further comprising a step a5) for bringing at least a portion of said hydrotreated liquid fraction into contact with at least a portion of the gaseous stream moving in loop REC1, the effluent from said step a5) being separated into a liquid contacting effluent and a gaseous contacting effluent, at least a portion of said gaseous contacting effluent being recycled to the loop REC1.

3. A process according to claim 1, further comprising one or more treatments carrying out at least partial elimination of the $H_2S$ contained in the recycle gas moving in the loops REC1 and REC2, in which each of the treatment or treatments is constituted by a combination of a step for bringing at least a portion of the recycle gas moving in the loop REC1 into contact with a liquid hydrocarbon fraction to carry out limited absorption of $H_2S$ by said liquid hydrocarbon fraction followed by a step for gas/liquid separation of the mixture issuing from said contact and direct evacuation of at least a portion of the separated liquid.

4. A process according to claim 1, in which the stripping step a2) is carried out in a stripping column comprising a section for rectification of stripping vapours using a liquid reflux.

5. A process according to claim 1, in which the vapours from the head of the stripping column are cooled to condense a relatively light, substantially desulphurized liquid hydrocarbon phase, the cooled vapours are separated from said relatively light hydrocarbon liquid phase in a reflux separator drum, a fraction of said relatively light hydrocarbon liquid phase is taken off and used as the liquid reflux for the stripping column, and at least a portion of the residual fraction of the relatively light hydrocarbon liquid phase is evacuated directly downstream.

6. A process according to claim 1, in which at least a portion of said purge gas is used as the stripping gas for step a2).

7. A process according to claim 1, in which the hydrotreatment step a3) is carried out with at least one catalyst comprising at least one noble metal or a noble metal compound selected from the group constituted by palladium and platinum.

8. A process according to claim 7, in which the degree of desulphurization in step a1) is selected so that the feed for step a3) has a sulphur content that is compatible with the sulphur tolerance threshold of the catalyst for step a3).

9. A process according to claim 1, in which the purity Pur2 of the hydrogen in the recycle loop REC2 is greater than the purity Pur1 of the hydrogen in the recycle loop REC1.

10. A process according to claim 1, in which the loops REC1 and REC2 are supplied with separate streams of makeup hydrogen with different purities, the purity of the makeup hydrogen stream supplying the loop REC2 being greater than that of the makeup hydrogen stream supplying the loop REC1.

11. A process according to claim 1, in which the pressure in step a3) is greater by at least 1.2 MPa and at most 12 MPa than that in step a1).

12. A process according to claim 1, in which the pressure in step a3) is lower by at least 0.1 MPa than that in step a1), and the partial pressure of hydrogen in step a3) is higher than the partial pressure of hydrogen in step a1).

13. A facility for hydrotreating a hydrocarbon feed to carry out the process according to claim 1, comprising:

a first hydrogen recycle loop REC1 said loop comprising at least one first hydrotreatment reactor 7 connected downstream to a column 10 for pressurized stripping of the liquid effluent from the reactor using a hydrogen-rich gas, the head of the column 10 being connected to a means 12 for cooling and partial condensation of the gas stream deriving from the column 10, said cooling and partial condensation means 12 being connected downstream to a first gas/liquid separator 14, itself connected to the intake of a first recycle compressor 22, the discharge of said first compressor being connected to a first hydrotreatment reactor 7;

a second hydrogen recycle loop REC2, separate from the loop REC1 said loop comprising at least one second hydrotreatment reactor 48, said reactor being connected upstream to the bottom of the stripping column 10, for hydrotreatment of the liquid effluent issuing from the bottom of the stripping column 10, and connected downstream to a second gas/liquid separator 53, itself connected to the intake for a second recycle compressor 55, the discharge from said second compressor being connected to the second hydrotreatment reactor 48.

14. A facility according to claim 13, in which the loop REC2 is supplied with hydrogen via one or more supply means 33, each of said supply means 33 being connected upstream exclusively to one or more external sources of hydrogen.

15. A facility according to claim 13, comprising at least one line 58 for supplying to loop REC1 a stream of purge hydrogen from the loop REC2, said line being connected upstream to a point in the loop REC2 and downstream to a point in the loop REC1.

16. A facility according to claim 13, comprising a first means 34 for supplying an external stream of makeup hydrogen of relatively low purity to the loop REC1, and a second means 33 for supplying an external stream of makeup hydrogen of relatively high purity to the loop REC2.

17. A facility according to claim 13, in which the stripping column comprises, above its supply point, a rectification zone having a separation efficiency of at least 1 theoretical plate.

18. A facility according to claim 13, comprising a line 27 for downstream evacuation of a light stripping liquid fraction, said line being connected upstream to the first gas/liquid separator 14.

* * * * *